US007346946B2

(12) United States Patent
Takeuchi

(10) Patent No.: US 7,346,946 B2
(45) Date of Patent: Mar. 25, 2008

(54) BENDABLE BOTTOM MEMBER FOR BED

(75) Inventor: Hiroshi Takeuchi, Tokyo (JP)

(73) Assignee: Paramount Bed Company, Ltd., Tokyo (JP)

( * ) Notice: Subject to any disclaimer, the term of this patent is extended or adjusted under 35 U.S.C. 154(b) by 0 days.

(21) Appl. No.: 10/765,958

(22) Filed: Jan. 29, 2004

(65) Prior Publication Data

US 2004/0181876 A1 Sep. 23, 2004

Related U.S. Application Data

(63) Continuation of application No. 10/005,129, filed on Dec. 7, 2001, now abandoned.

(51) Int. Cl.
*A47B 7/02* (2006.01)
*A47C 19/00* (2006.01)

(52) U.S. Cl. ..... 5/617; 5/186.1; 5/188; 5/613; 5/618

(58) Field of Classification Search ..... 5/617, 5/186.1, 188, 613, 618
See application file for complete search history.

(56) References Cited

U.S. PATENT DOCUMENTS 4,222,134 A * 9/1980 Degen ..... 5/191
4,696,070 A * 9/1987 Degen ..... 5/238
4,785,487 A * 11/1988 Toran ..... 5/613
5,222,263 A * 6/1993 Magistretti ..... 297/29
5,369,826 A * 12/1994 Ikeda ..... 5/613
5,377,369 A * 1/1995 Shirai ..... 5/236.1
5,388,290 A * 2/1995 Shirai ..... 5/236.1
5,469,591 A * 11/1995 Nomura ..... 5/613
5,475,880 A * 12/1995 Guenther ..... 4/578.1
6,061,873 A * 5/2000 Fry ..... 16/271

* cited by examiner

*Primary Examiner*—Katherine Mitchell
*Assistant Examiner*—David C Reese
(74) *Attorney, Agent, or Firm*—Townsend & Banta

(57) ABSTRACT

A bed having a bendable portion between a back region and waist region and/or a waist region and leg region. The bendable portion is formed of side by side bars disposed generally perpendicular to the longitudinal axis of the bed and bendably connected together to allow the whole extent of the connecting bars to be shortened, extended, and curved. The bars are connected by protrusions on one bar extending into recesses of an adjacent bar. Side by side bars can be adjusted in their intervals and can be rotated in one direction up to a predetermined angle.

2 Claims, 10 Drawing Sheets

BENDABLE BOTTOM MEMBER FOR BED

CROSS REFERENCE TO A RELATED APPLICATIONS

This is a continuation patent application of application Ser. No. 10/005,129 filed Dec. 7, 2001, now abandoned.

FIELD OF THE INVENTION

This invention relates to a bendable bottom member for a bed capable of being lifted in the back bottom member, leg bottom member, etc., to be used for the bendable portion between the back region and the waist region and/or between the waist region and the leg region.

BACKGROUND OF THE INVENTION

A bed capable of being lifted in the back bottom member, leg bottom member, etc. has a basic constitution in which the deck is divided into a plurality of regions, say, back region, waist region, leg region and foot region and in which the respective regions are connected bendably with each other or some of them are supported pivotally rotatably on a frame supporting the bottom, so that they can be bent.

However, for example, if the bed is designed to allow the back region and the waist region to be bent by simple pivotal rotation, the mattress supported on the bottom is compressed by the bent back bottom member and waist bottom member, and the bed user such as a patient lying on the mattress is displeased by the pressure felt on the abdomen disadvantageously. To overcome this advantage, various measures have been proposed.

Also the present applicant has proposed various bottom structures which can be curved at a moderate curvature to ensure that the bendable portion between the back region and the waist region or between the waist region and the leg region can suit the bending posture of the human body lying on the bed. For example, the proposals by the present applicant are described in the gazettes of JP, 6-343533, JP, 7-75657, JP, 7-124038 and JP, 9-577. Proposals by other applicants include, for example, the gazette of JP, 10-234523.

Also as described in these previous proposals, one method for achieving the object of obtaining a bottom member capable of being curved at a moderate curvature to suit the bending posture of the human body lying on the bed at the bendable portion between the back region and the waist region or between the waist region and the leg region is to increase the number of bendable points of the bottom member used for the bendable portion.

For example, in the description in said gazette of JP, 10-234523, a back bottom member consists of a liftable portion corresponding to the end side and an extendable and bendable portion corresponding to the waist side.

The extendable and bendable portion consists of three plates which are connected with each other by engagement between connecting shafts and slots, to allow the whole extent of the connected plates to be shortened and extended and to be bent from each other. Of the three connected plates, the plate on one end side is connected bendably with the liftable portion by connecting shafts, and the plate at the other end is connected bendably with the waist bottom member by connecting shafts.

In this constitution, if the liftable portion of the back bottom member is lifted to bend at the connection with the waist bottom member, the three plates constituting the extendable and bendable portion are respectively moved to form a curve. Since the entire region is bent at four points, the region from the liftable portion of the back bottom member to the waist bottom member is curved at a moderate curvature while being extended as a whole, and thus it is intended to avoid that the bed user is displeased by the pressure felt at the abdomen.

In this way, it is effective to increase the number of bending points of the bending portion of a bottom member as one of measures for achieving the object of obtaining a bottom member curved at a moderate curvature. However, the constitution that adjacent plates are engaged with each other using connecting shafts and slots to form a curve in any direction by simple pivotal rotation at the engagement, as adopted in the above extendable and bendable portion, has the following problems.

(a). The extendable and bendable portion has a high degree of freedom in the entire form since the number of bending points is as many as four, but since it can be bent in any direction at the respective bending points, the respective plates do not always move evenly in the transfer from the shortened flat state to the extended curved state or in the transfer reverse to it, and any local load lowers the corresponding plate downward to change the entire form, lowering the stability of the entire form. So, in the extended state, the extendable and bendable portion is not always curved at a proper angle, and it can happen that the bed user feels instability.

(b). The extendable and bendable portion cannot have a desired entire form unless it is manufactured by letting the length of the shortened flat state and the length of the extended curved state are adapted to the actual distances between the liftable portion of the back bottom member and the waist bottom member. For example, if the extended critical length of the extendable and bendable portion is longer than the actual length between the liftable portion of the back bottom member and the waist bottom member, the portion is in a state of hanging down, to fall more than necessary, and if shorter, the portion is raised more than necessary. Furthermore, if the shortened critical length is longer than the actual distance between the liftable portion of the back bottom member and the waist bottom member, the portion is pressed by the lifting portion and the waist bottom member, to be bent at any point.

SUMMARY OF THE INVENTION

This invention has been conceived in view of the above.

This invention to solve the above problems proposes a bendable bottom member, in which a plurality of bars are disposed side by side and connected bendably with each other to allow the whole extent of the connected bars to be shortened and extended and to be curved, characterized in that one of every adjacent two of the bars is provided with a plurality of longitudinal connecting protrusions in the transverse direction on one face of the bar facing the adjacent bar, while recesses for accepting the respective connecting protrusions are formed in the corresponding face of the adjacent bar, in such a manner that the connecting protrusions of each of the bars can be inserted into the corresponding recesses of the adjacent bar, to connect the plurality of bars one after another for allowing the whole extent of the connected bars to be shortened and extended; that disengagement preventing means are formed in some of the connecting protrusions and in the corresponding accepting recesses, so that they are engaged with each other when the respectively adjacent bars are kept farthest away from each other; and that the connecting protrusions have, at the tips and bases thereof, beveled portions for forming the clearances to allow the connected bars to be bent in one direction.

Furthermore, in this invention, in the above constitution, the bar disposed at the end of the bendable bottom member on one side can have the accepting recesses only.

Furthermore, in this invention, in the above constitution, beveled portions can be formed on the lower sides at the tips of the connecting protrusions while beveled portions can be formed on the upper sides at the bases, to use the bendable bottom member as a bendable portion between the back region and the waist region.

Furthermore, in this invention, in the above constitution, beveled portions can be formed on the upper sides at the tips of the connecting protrusions while beveled portions can be formed on the lower sides at the bases, to use the bendable bottom member as a bendable portion between the waist region and the leg region.

Furthermore, in this invention, in the above constitution, the beveled portions at the bases of the connecting protrusions can be inclined in adaptation to the desired bending angles with the adjacent bars.

Furthermore, in this invention, in the above constitution, hooks can be formed at the tips of the connecting protrusions provided with the disengagement preventing means while steps to be engaged with the hooks can be formed in the corresponding accepting recesses.

In this invention described above, the connecting protrusions inserted in the accepting recesses of respectively adjacent bars are allowed to be relatively inclined in one direction in the accepting recesses by the clearances formed by the beveled portions, and the inclination angles are limited up to a predetermined angle.

Therefore, since the connecting protrusions of the bars are inserted into the accepting recesses of the respectively adjacent bars, to connect a plurality of bars one after another for allowing the whole extent of the connected bars to be extended and shortened, a lattice-like bottom member which can be extended and shortened and can be curved in one direction can be obtained.

Since the beveled portions to form the clearances to allow bending are formed not only at the tips of the connecting protrusions but also at the bases, the connected bars can be bent in a state where the connecting protrusions are most shallowly inserted in the accepting recesses, i.e., when the respectively adjacent bars are farther apart from each other, as well as in a state where the connecting protrusions are most deeply inserted in the accepting recesses, i.e., when the respectively adjacent bars are closer to each other.

Especially if the beveled portions at the bases of the connecting protrusions are inclined in adaptation to the desired bending angle with the respectively adjacent bars, the connected bars can be bent up to almost the same angle irrespective of how deeply the connecting protrusions are inserted in the accepting recesses, i.e., irrespective of the distances between the respective adjacent bars.

For this reason, in the bendable bottom member of this invention, irrespective of whether it is shortened or extended, the adjacent bars can be bent in one direction, being guided by the connecting protrusions and the accepting recesses, and so, the whole extent can be curved at a proper angle. Furthermore, since the respective bending angles are limited up to a predetermined angle, a curve at a proper angle can be maintained since it does not happen that any local load moves some bars downward to change the entire form.

The bendable bottom member of this invention as described above is used at the bendable portion between the back region and the waist region or between the waist region or the leg region as described above. For example, in the former case, it is connected between the end of the back bottom member and the waist bottom member when used. In this case, the bars can be disposed with either of the connecting protrusions or the accepting recesses on the upper sides.

In the former case, if the back bottom member is pivotally rotated to ascend, at first the bar at the end on the back bottom member side is lifted to move in the direction to be apart from the adjacent bar, and in this motion, the connecting protrusions are moved to be relatively more shallow in the accepting recesses while being bent relatively to the accepting recesses from the beginning due to the beveled portions at the bases.

If the clearance between the adjacent bars is extended to a predetermined distance, the disengagement preventing means act, and the bar at the end pulls the adjacent bar through the connecting protrusions. The latter bar then pulls the next adjacent bar, and since this action is repeated from bar to bar, the respectively adjacent bars are bent one after another while being extended upward.

As described above, in the bendable bottom member of this invention, irrespective of whether it is shortened or extended, the respectively adjacent bars can be bent in one direction, being guided by the connecting protrusions and the accepting recesses, and since the respective bending angles are limited up to a predetermined angle, it does not happen that any local load moves some of the bars downward to change the entire form. So, irrespective of whether the bendable bottom member is shortened or extended, it can be stably curved at a moderate curvature as a whole.

Because of the above, in the bendable bottom member of this invention, it is not necessary to let the length of the most extended curved state accurately agree with the actual distance between the end of the back bottom member and the waist bottom member, and it is only required that at least the length of the most shortened flat state is kept smaller than the actual distance between the end of the back bottom member and the waist bottom member. So, a high degree of freedom is assured in design to avoid mechanical inconsistency.

DETAILED DESCRIPTION OF THE PREFERRED EMBODIMENT

A preferred embodiment of this invention is described below in reference to the drawings.

Figure 1:
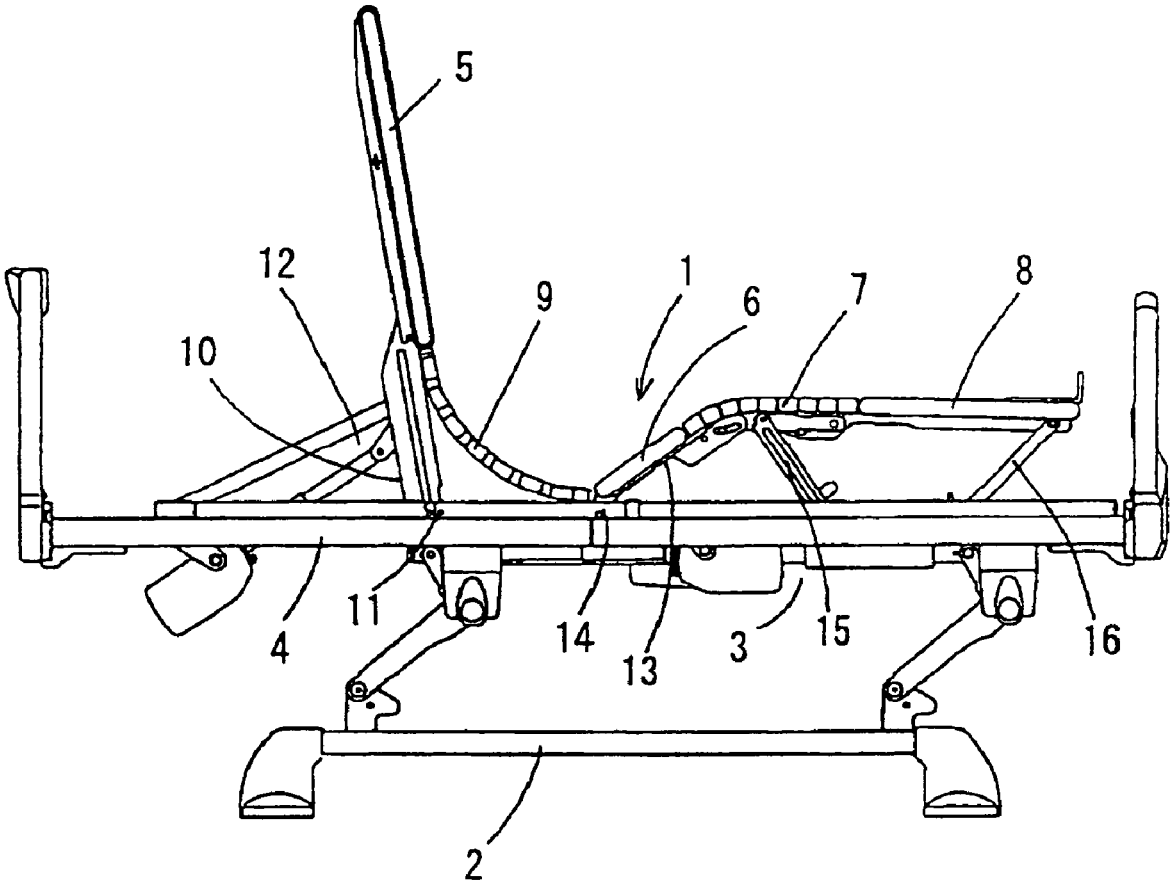
FIG. 1 is a front view schematically showing a bed in which the bendable bottom member of this invention is applied, where it is curvewise lifted.
Figure 2:
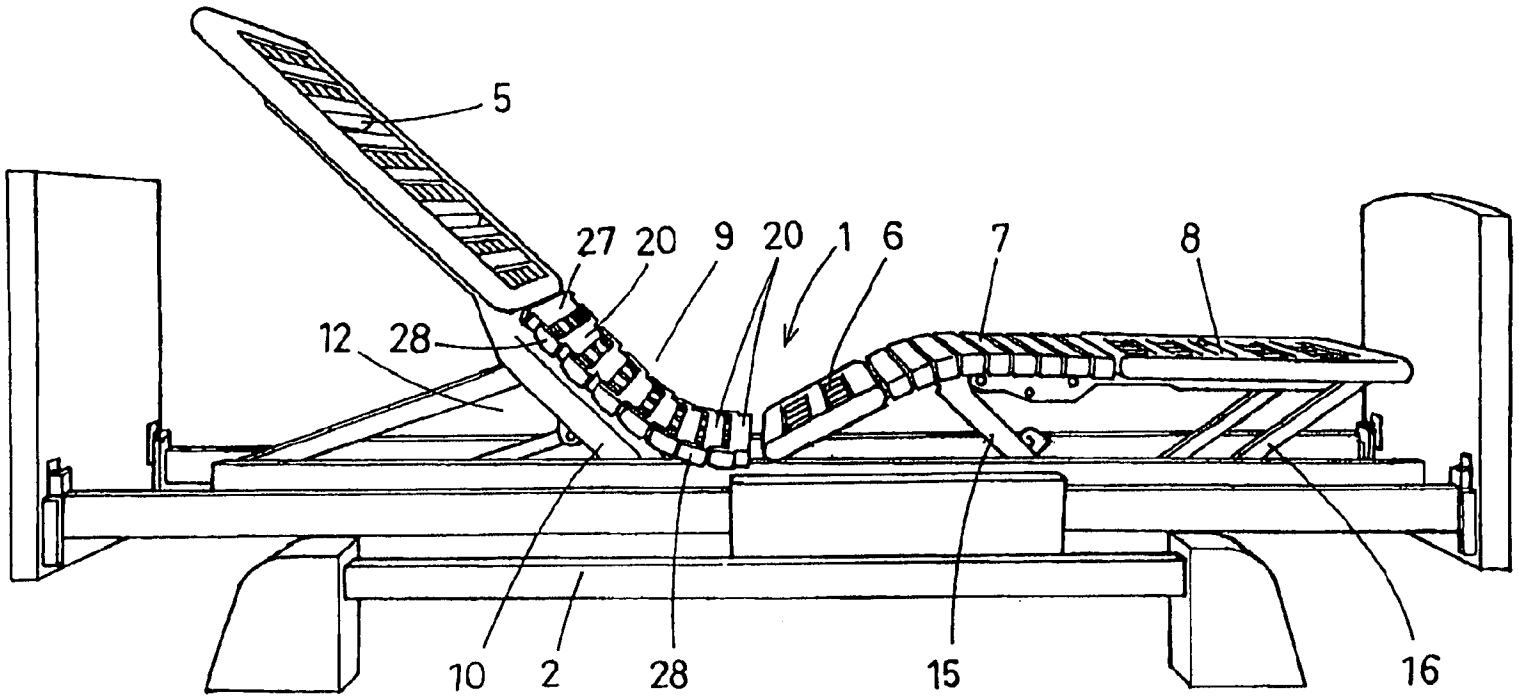
FIG. 2 is a perspective view schematically showing a bed in which the bendable bottom member of this invention is applied, where it is curvewise lifted.
Figure 3:
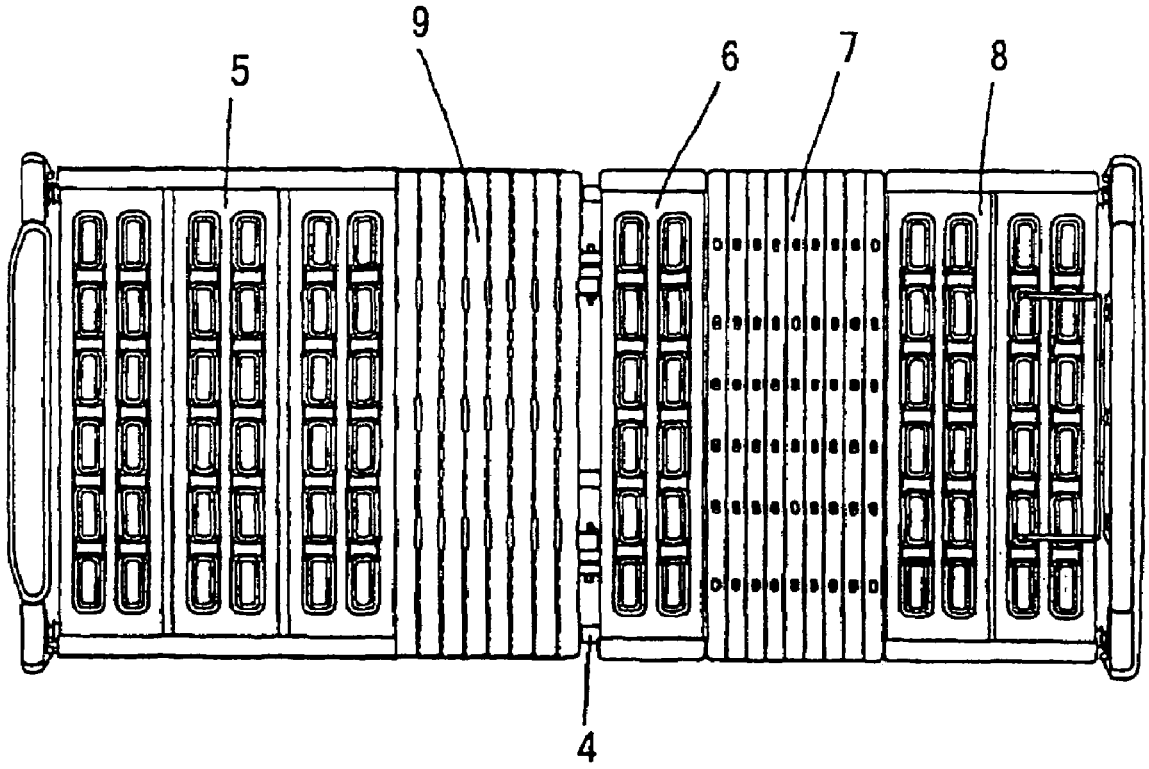
FIG. 3 is a plan view schematically showing a bed in which the bendable bottom member of this invention is applied, where it is kept flat.
Figure 4:
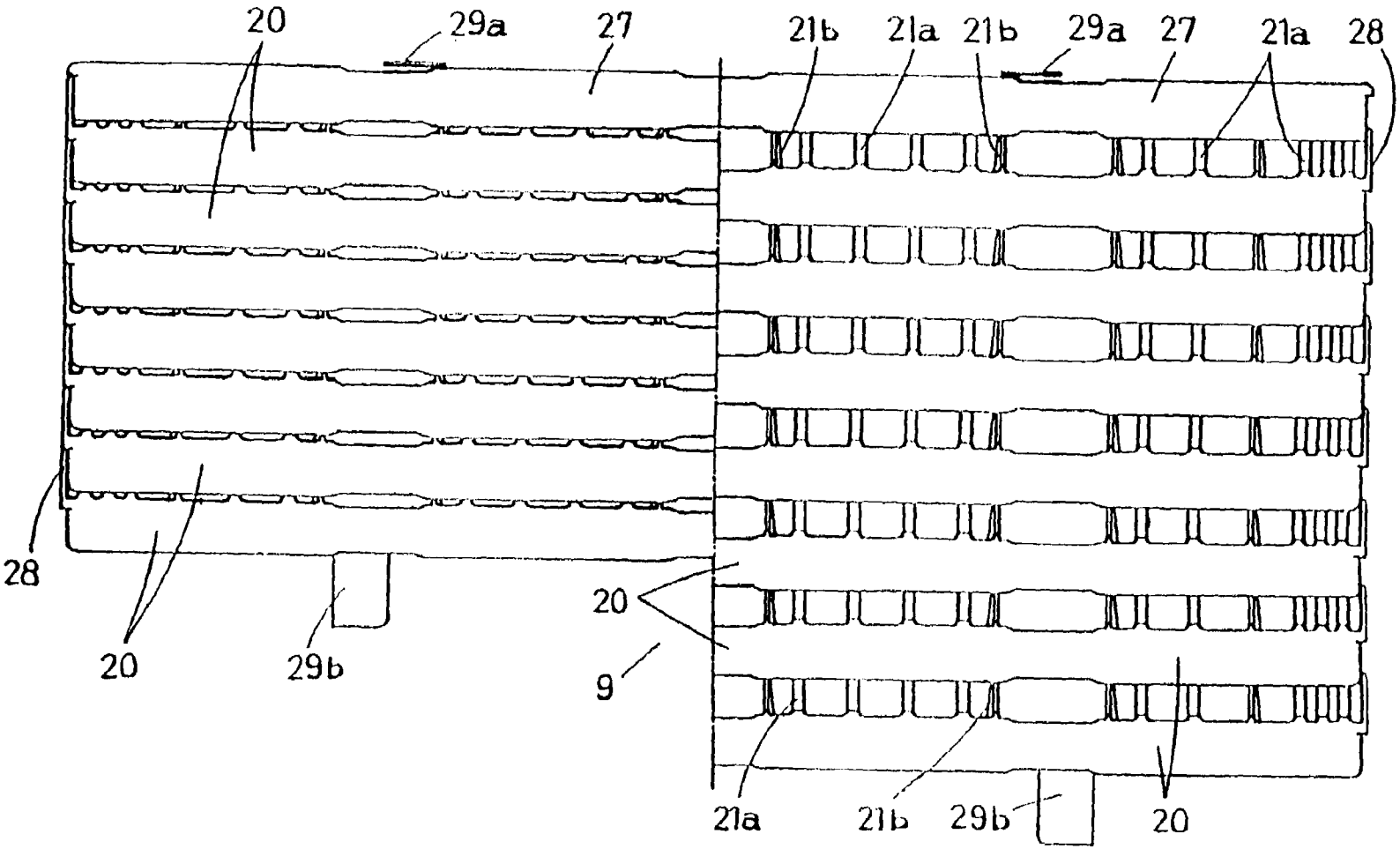
FIG. 4 is a plan view showing the bendable bottom member as a whole, in which the extended state is shown on the right side of the center line while the shortened state is shown on the left side of the center line.
Figure 5:
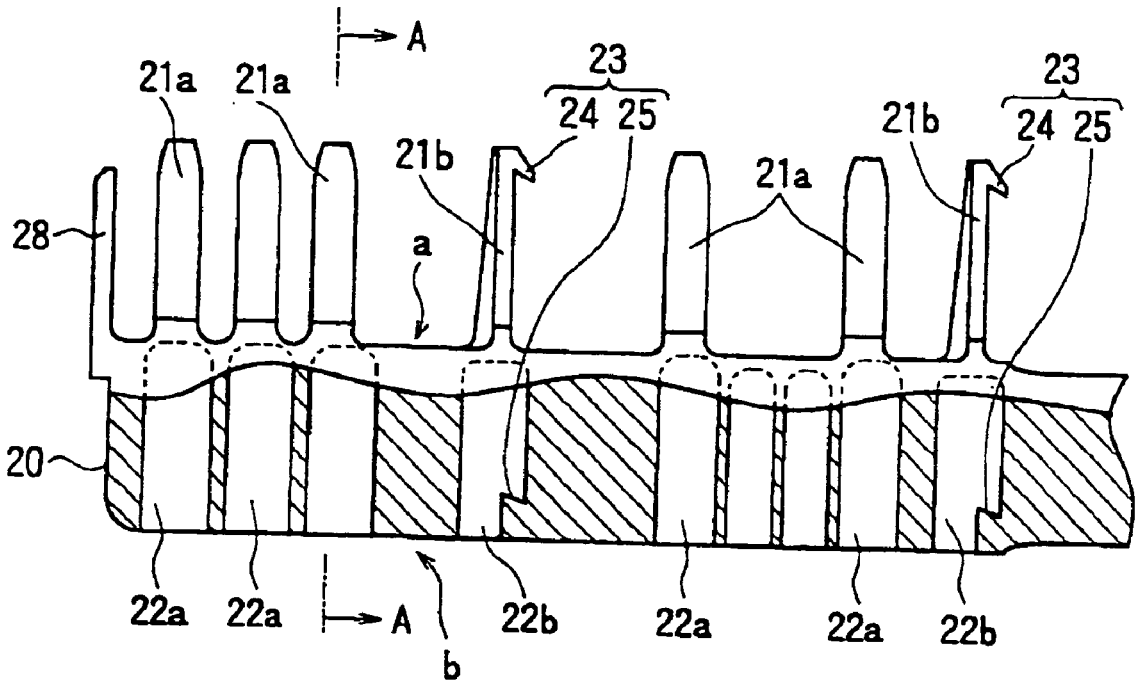
FIG. 5 is a partial sectional view showing a part of a bar as a component of the bendable bottom member.
Figure 6:
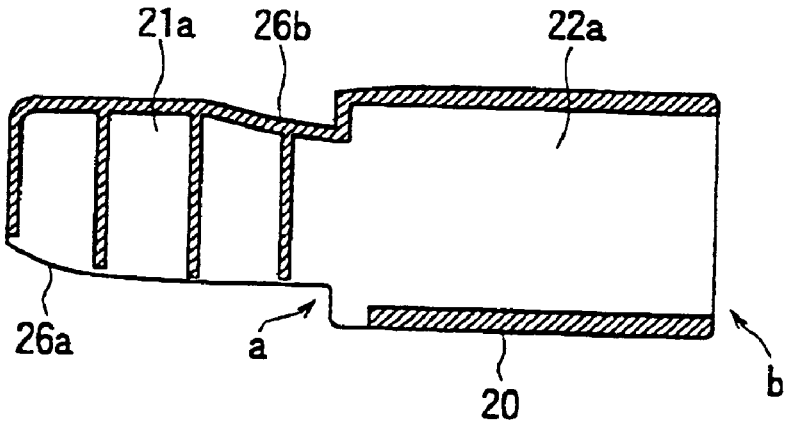
FIG. 6 is an A-A line sectional view of FIG. 5.
Figure 7:
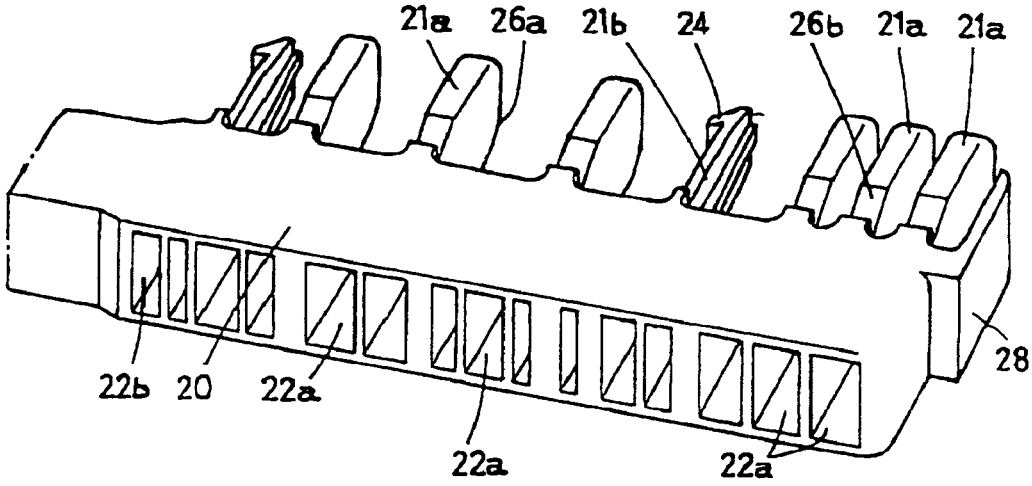
FIG. 7 is a partial perspective view of a bar from the side of accepting recesses.
Figure 8:
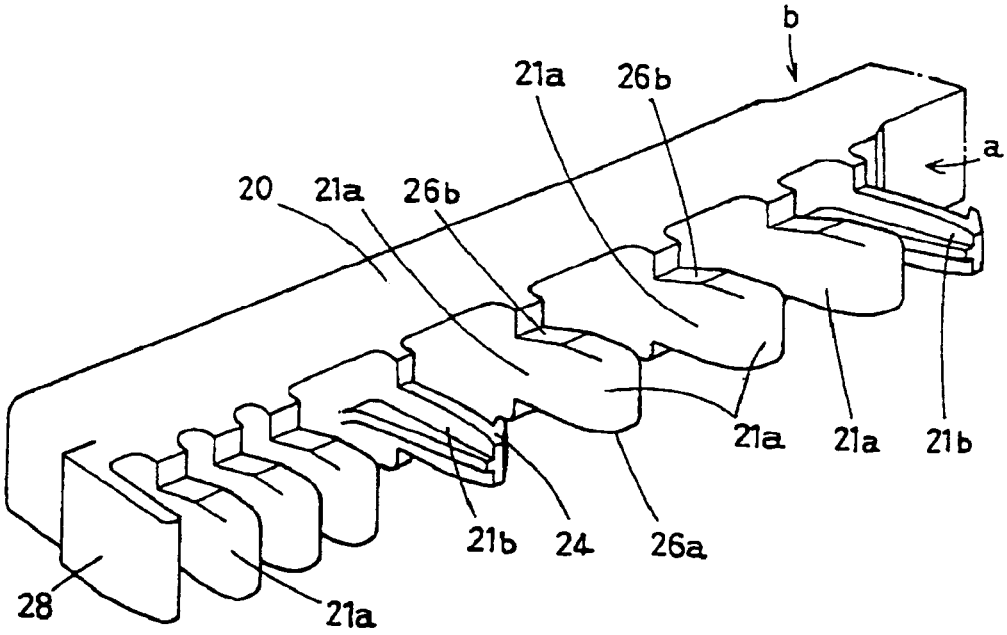
FIG. 8 is a partial perspective view of a bar from the side of connecting protrusions.

At first, in FIGS. 1 through 3, symbol 1 generally denotes a bottom which is curvewise liftably supported on a deck support frame 4 liftably supported by a proper lifting mechanism 3 above a base frame 2.

The bottom 1 consists of a back bottom member 5, a waist bottom member 6, a knee bottom member 7, a leg bottom member 8 and a bendable bottom member 9 of this invention disposed between the back bottom member 5 and the waist bottom member 6.

The back bottom member 5 is supported by a pivotally rotating arm 10 and pivotally rotated around a fulcrum 11, to be lifted by a back lifting mechanism 12, and the waist bottom member 6 is supported by a pivotally rotating arm 13 and pivotally rotated around a fulcrum 14, to be lifted. On the other hand, the knee bottom member 7 connected between the waist bottom member 6 and the leg bottom member 8 is a bendable bottom member constituted differently from this invention, for example, a bendable bottom as described in the patent gazette of Japanese Patent No.2700056. The knee bottom 7 and the leg bottom 8 can be lifted by pivotally rotatable arms 15 and 16 respectively.

To describe in reference to FIGS. 4 through 12, the bendable bottom member 9 of this invention is constituted by a plurality of bars 20 (20, 20, . . . ) bendably connected with each other to allow the whole extent thereof to be extended and shortened and to be curved. One of every adjacent two of the bars 20 is provided with a plurality of longitudinal connecting protrusions 21 in the transverse direction on one face a of the bar facing the adjacent bar while recesses 22 for accepting the respective connecting protrusions are formed in the corresponding face b of the adjacent bar. Disengagement preventing means 23 are formed in some of the connecting protrusions 21, i.e., the connecting protrusions indicated by symbol 21*b* and in the corresponding accepting recesses (indicated by 22*b*), so that they are engaged with each other when the respectively adjacent bars 20 and 20 are farthest away from each other. Concretely, hooks 24 inclined at the tips are formed at the tips of the connecting protrusions 21*b*, and steps 25 are formed in the accepting recesses 22*b*, for forming the disengagement preventing means 23. The bars 20 formed as described above can be produced, for example, by integral molding of a plastic material. The connecting protrusions and the accepting recesses not provided with the disengagement preventing means 23 are indicated by symbols 21*a* and 21*b* respectively. The connecting protrusions 21*a* have the required minimum play in relation with the accepting recesses 22*a*, but the connecting protrusions 21*b* are formed to be longitudinally narrow.

The constitution of each of the connecting protrusions 21*a* is described below in more detail. The connecting protrusion 21*a* has required minimum play in relation with the accepting recess 22*a*, and beveled portions 26 for forming the clearances to allow bending in one direction are formed at the tip and the base of the connecting protrusion 21*a*. That is, in this embodiment, a beveled portion 26*a* is formed on the lower side at the tip of the connecting protrusion 21*a*, and a beveled portion 26*b* is formed on the upper side at the base. In this case, the beveled portion 26*a* formed on the lower side at the tip forms a gently inclined curved surface, and the beveled portion 26*b* formed on the upper side at the base forms a gently inclined curved surface almost in parallel to the beveled portion 26*a*.

Figure 9:
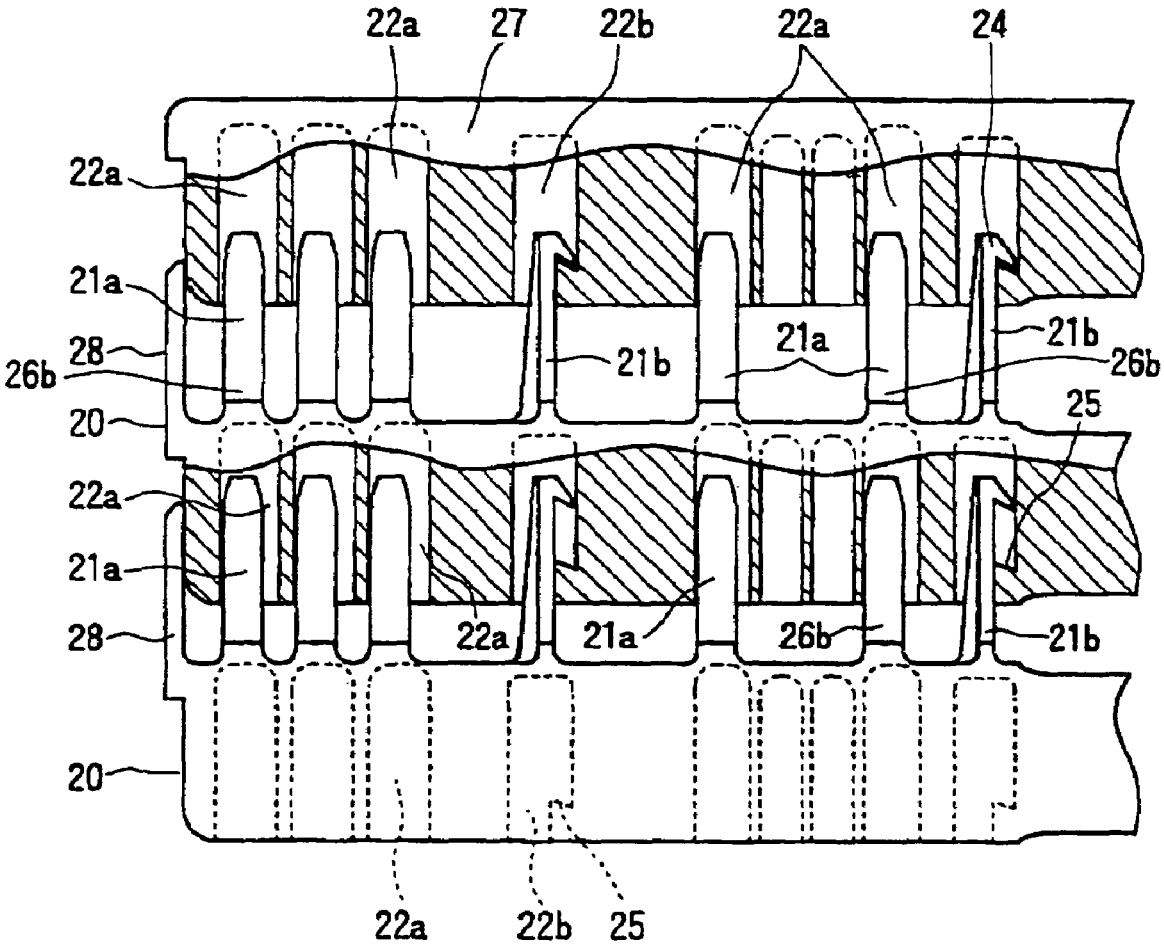
FIG. 9 is a plan view showing a state where a plurality of bars are connected.
Figure 10:
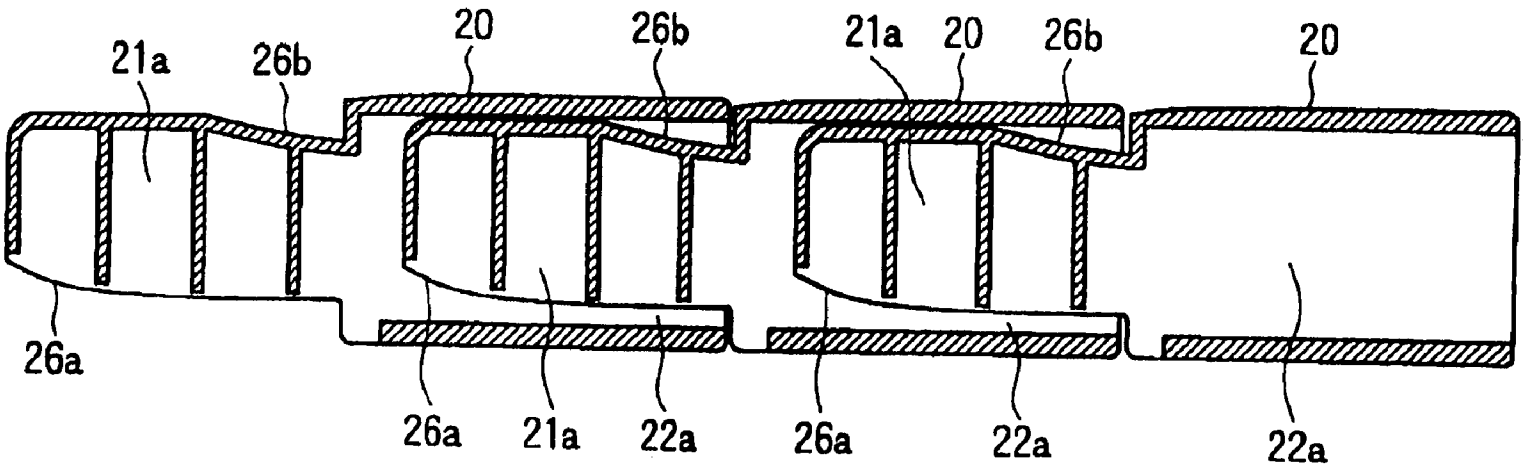
FIG. 10 is a sectional view showing a connected state.

The connecting protrusions 21 of the bars 20 constituted as described above are inserted into the accepting recesses 22 of the respectively adjacent bars 20 as shown in FIGS. 9 and 10 to connect the plurality of bars 20 one after another for allowing the whole extent of the connected bars to be extended and shortened.

When the respectively adjacent bars 20 are connected one after another, the connecting protrusions 21*b* are forced into the narrow openings formed before the steps 25 while being elastically deformed at the inclined portions at the tips, and are released into the wider openings formed beyond the steps 25, to restore their original forms elastically, thus causing the hooks 24 to be positioned to face the steps 25 in disengagement preventing disposition. Thereafter, since the hooks 24 are caught by the steps 25, the connecting protrusions 21*b* cannot be disengaged from the accepting recesses 22*b* any more.

Symbol 27 denotes a bar disposed at one end of the bendable bottom member 9, and the bar 27 is not provided with the connecting protrusions and is provided with accepting recesses 22*a* and 22*b* only unlike the other bars 20.

At both the ends of each of the bars 20, extensions 28 are projected and extend in the same direction as the connecting protrusions 21. The distance between the extensions 28 at both the ends is slightly longer than the length of the bar 20, and the extensions 28 extend to cover the clearance formed with the adjacent bar 20.

In the above constitution, the plurality of bars 20 are connected one after another by the connecting protrusions 21 and the accepting recesses 22 to allow the whole extent of the connected bars to be extended and shortened, and the bar 27 is connected at the end to form the lattice-like bendable bottom 9 which can be extended and shortened and can also be curved.

In the above constitution, the connecting protrusions 21*a* inserted in the accepting recesses 22*a* of respectively adjacent bars 20 are allowed to be bent in one direction relatively to the accepting recesses 22*a* by the clearances formed by the beveled portions 26*a* and 26*b*, and the bending angles are limited upto a predetermined angle.

Figure 11:
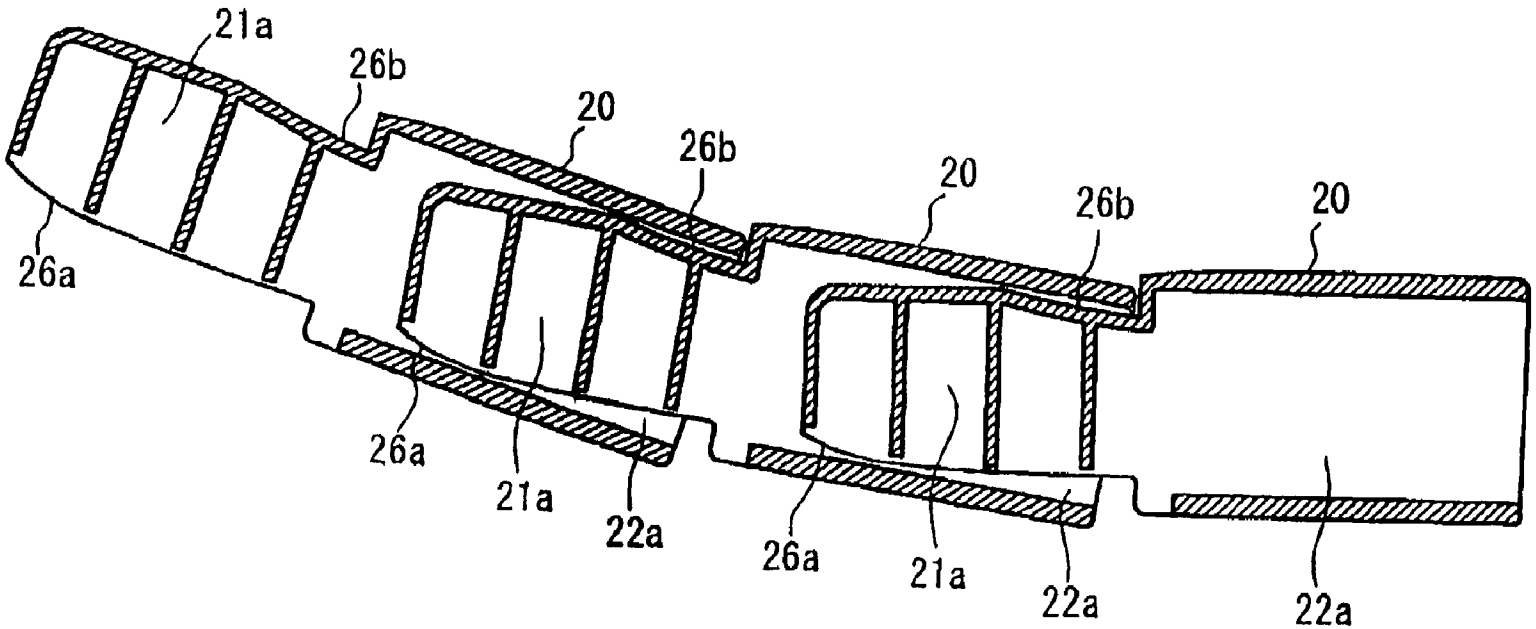
FIG. 11 is a sectional view conceptually showing a state where connected bars are bent in the shortened state.
Figure 12:
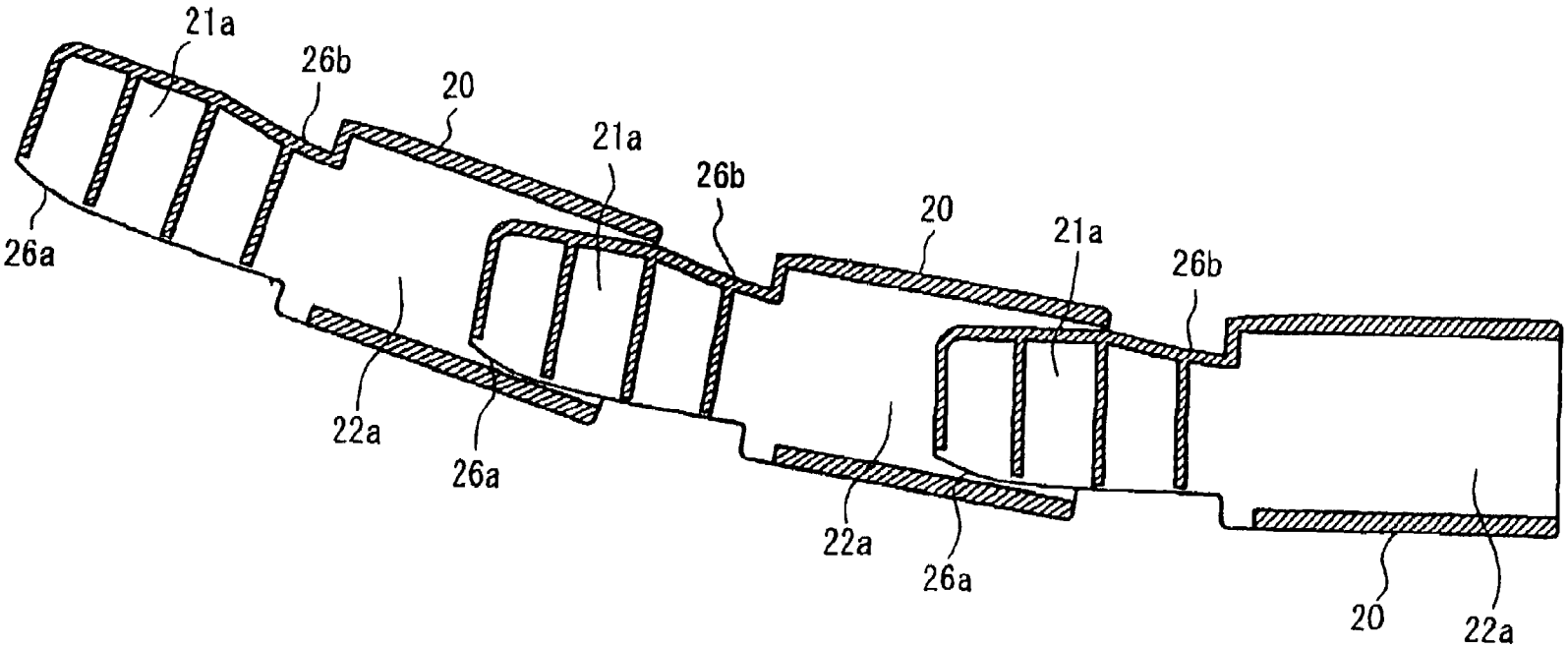
FIG. 12 is a sectional view conceptually showing a state where connected bars are bent in the extended state.

Since the beveled portions to form the clearances for allowing bending are formed not only at the tips 26*a* but also at the bases 26*b*, the connecting protrusions 21*a* can be bent relatively to the accepting recesses 22*a* due to the clearances formed by the beveled portions 26*a* and 26*b*, not only in a state where the connecting protrusions 21*a* are shallowly inserted in the accepting recesses 22*a*, that is, when the respectively adjacent bars 20 are farther away from each other as shown in FIG. 12, but also in a state where the connecting protrusions 21*a* are deeply inserted in the accepting recesses 22*a*, that is, when the respectively adjacent bars 20 are closer to each other as shown in FIG. 11.

In this embodiment, the beveled portions 26*b* at the bases of the connecting protrusions 21*a* are inclined in adaptation to the desired bending angle with the adjacent bars, and in this constitution, the respectively adjacent bars can be bent up to almost the same angle irrespective of how deeply the connecting protrusions 21*a* are inserted in the accepting recesses 22*a*, that is, irrespective of the distances between the respectively adjacent bars 20.

Of course, the bending angles can also be changed as required in response to how deeply the connecting protrusions 21*a* are inserted in the accepting recesses 22*a*, that is, the distances between the respectively adjacent bars 20.

So, in the bendable bottom member 9 of this invention, irrespective of whether it is shortened or extended, the connected bars 20 can be bent in one direction, that is, in the direction shown in FIGS. 11 and 12, being guided by the connecting protrusions 21*a* provided with the beveled portions 26*a* and 26*b*. Therefore, the whole extent of the connected bars can be curved at a proper angle, and since the respective bending angles are limited up to a predetermined angle, it does not happen that any local load moves some of bars downward to change the entire form, and the bendable bottom can be kept curved at an appropriate angle.

The bendable bottom member 9 of this invention as described above is used as the bendable portion between the back region and the waist region and/or the waist region and the leg region of a bed as described above. If it is used between the back region and the waist region, the bar 27 forming one end of the bendable bottom member 9 is connected with the end of the back bottom member 5, and the bar 20 forming the other end of the bendable bottom member 9 is connected with the end of the waist bottom member 6. Symbols 29*a* and 29*b* denote connection fittings.

In the above constitution, when the back bottom member 5 and the waist bottom member 6 are flat, the bendable bottom member 9 is shortened, and the bendable bottom member 9 in this state is supported on the frame, etc. (not illustrated) provided below.

Then, if the lifting mechanism 12 is actuated to pivotally rotate the back bottom member 5, to lift it, the bar 27 at the end on the side of the back bottom member 5 is at first lifted, to move to be apart from the adjacent bar 20, and in this motion, the connecting protrusions 21*a* are moved to be more shallow in the accepting recesses 22*a* while being adequately bent from the beginning as conceptually shown in FIG. 11, as guided by the beveled portions 26*b* at the bases.

If the clearance between the adjacent bars 20 is extended to a predetermined distance, the disengagement preventing means 23 act, that is, the steps 25 of the accepting recesses 22*b* contact the hooks 24 of the connecting protrusions 21*b*. So, the bar 27 at the end pulls the adjacent bar 20 through the connecting protrusions 26*a*, and the bar 20 acts similarly on the next adjacent bar 20. Thus, as shown in FIG. 12, the respectively adjacent bars 20 are moved upward one after another, to be extended upward as a whole.

If the back bottom member 5 is pivotally rotated to be lifted as predetermined, the bendable bottom member 9 of this invention is also extended and curved accordingly.

As described above, in the bendable bottom member 9 of this invention, irrespective of whether it is shortened or extended, the respectively adjacent bars 20 can be bent in one direction, being guided by the connecting protrusions 21*a* and the accepting recesses 21*b*, and in this case, since the respective bending angles are limited up to a predetermined angle, it does not happen that any local load moves some of bars downward to deform the entire form. Thus, irrespective of whether the bottom member is shortened or extended, it can be stably curved at a proper angle, hence can be curved at a moderate curvature as a whole.

As can be seen from the above description, in the bendable bottom member 9 of this invention, it is not necessary to let the length of the most extended curved state agree with the actual distance between the end of the back bottom member 5 and the waist bottom member 6, and it is only required that at least the length of the most shortened flat state is kept shorter than the actual distance between the end of the back bottom member 5 and the waist bottom member 6. So, a high degree of freedom is assured in design to avoid mechanical inconsistency.

INDUSTRIAL APPLICABILITY

Since this invention is as described above, it has the following effects.

(a). The bendable bottom member of this invention can be a lattice-like bottom member capable of being extended and shortened and being curved in one direction by inserting the connecting protrusions of bars into the accepting recesses of the respectively adjacent bars to connect a plurality of bars one after another to allow the whole extent of the connected bars to be extended and shortened.

(b). In the bendable bottom member of this invention, irrespective of whether it is shortened or extended, the respectively adjacent bars can be bent in one direction, being guided by the connecting protrusions and the accepting recesses, and in this case, since the respective bending angles are limited up to a predetermined angle, it does not happen that any local load moves some of bars downward to change the entire form. Thus, irrespective of whether the bottom member is shortened or extended, it can be stably curved at a proper angle, hence can be curved at a moderate curvature as a whole.

(c). So, in the bendable bottom member of this invention, if it is used between the back region and the waist region, it is not necessary to let the length of the most extended curved state agree with the actual distance between the end of the back bottom member and the waist bottom member, and it is only required that at least the length of the most shortened flat state is kept shorter than the actual distance between the end of the back bottom member and the waist bottom member. So, a high degree of freedom is assured in design to avoid mechanical inconsistency.

The invention claimed is:

1. A bendable bottom member of a bed, comprising:

(a) a plurality of side-by-side bars bendably connected to each other, allowing the whole extent of the connected side-by-side bars to be shortened, extended, and curved, said side-by-side bars being disposed generally perpendicular to the longitudinal axis of the bed, (b) a plurality of longitudinal connecting protrusions disposed on one of every adjacent two of the side-by-side bars being provided on one face of said side-by-side bar, said longitudinal connecting protrusions extending generally parallel to the longitudinal axis of the bed, said protrusions having an approximate rectangular cross-section taken in a direction perpendicular to the longitudinal axis of the bed, and an elongated generally rectangular cross-section tapered at its tip on a bottom face thereof taken in a direction parallel to the longitudinal axis of the bed, said protrusions having first and second beveled portions at tips and bases thereof, said first beveled portion being formed on a bottom face of each protrusion at its tip and on lower sides at tips of the connecting protrusions, and said second beveled portion being formed on a top face of each protrusion at its base and on upper sides at the bases of protrusions;

(c) a plurality of recesses having an approximate rectangular cross-section taken in a direction perpendicular to the longitudinal axis of the bed, said recesses having right and left lateral walls and top and bottom walls formed in a corresponding face of adjacent bars for accepting protrusions extending from an adjacent bar, for accepting respective connecting protrusions, said recesses accommodating the insertion in a direction parallel to the longitudinal axis of the bed of said protrusions therein in sliding engagement therewith in a direction parallel to the longitudinal axis of the bed, so that top and bottom walls of each of the recesses contact a top and bottom face of a corresponding protrusion inserted therein;

(d) disengagement preventing means comprising hooks formed at a tip of some of the connecting protrusions; and (e) corresponding accepting recesses having steps therein adapted to engage the hooks, so that the hooks and steps are engaged with each other when the respective adjacent bars are kept furthest away from each other, said adjacent bars being adjustable in gaps between adjacent bars, said bars being connected with each other in such a manner that they can be curved as a whole up to a limited predetermined angle in one direction only, wherein said first and second beveled portions form clearances between the protrusions and corresponding faces of the recesses to allow the connecting bars to be bent a preset distance in one direction only, and the second beveled portions at bases of connecting protrusions are inclined in adaptation to desired bending angles with adjacent bars so that adjacent bars can be adjusted in their intervals and can be rotated in one direction up to a predetermined angle, and a gap is formed between every adjacent two connecting protrusions.

2. The bendable bottom member of a bed according to claim 1, wherein a bar disposed at an end of the bendable bottom member on one side has only accepting recesses.

* * * * *